United States Patent [19]

Beneke et al.

[11] 4,320,560

[45] Mar. 23, 1982

[54] DRIVE FOR A PLURALITY OF ROTARY CARDING COMPONENTS

[75] Inventors: Wolfgang Beneke; Jürgen Klüttermann, both of Monchen-Gladbach, Fed. Rep. of Germany

[73] Assignee: Trützschler GmbH & Co. KG, Monchen-Gladbach, Fed. Rep. of Germany

[21] Appl. No.: 120,515

[22] Filed: Feb. 11, 1980

[30] Foreign Application Priority Data

Feb. 9, 1979 [DE] Fed. Rep. of Germany ..... 2904852

[51] Int. Cl.[3] ..... D01G 15/26; D01G 15/36

[52] U.S. Cl. ..... 19/98; 19/106 R

[58] Field of Search ..... 19/98, 106 R

[56] References Cited

U.S. PATENT DOCUMENTS 3,530,542 9/1970 Burnham ..... 19/106 R 3,999,249 12/1976 Katoh et al. ..... 19/98 X

*Primary Examiner*—Louis Rimrodt

*Attorney, Agent, or Firm*—Spencer & Kaye

[57] ABSTRACT

A drive for a plurality of rotary components of a carding machine comprises a first gear connected to and driven by a motor, a second gear affixed to a shaft and connected slip-free to the first gear to rotate the shaft, a third gear affixed to the shaft, fourth and fifth gears connected to respective first and second rotary components of the carding machine and driven slip-free by the third gear, a sixth gear affixed to the shaft, seventh and eighth gears connected to respective third and fourth rotary components of the carding machine, an additional shaft connected to a fifth rotary component of the carding machine, a ninth gear affixed to the additional shaft; the sixth gear driving slip-free the seventh, eighth and ninth gears, a tenth gear affixed to the additional shaft; and an eleventh gear connected to a sixth rotary component of the carding machine and driven slip-free by the tenth gear.

11 Claims, 7 Drawing Figures

DRIVE FOR A PLURALITY OF ROTARY CARDING COMPONENTS

BACKGROUND OF THE INVENTION

This invention relates to a drive for a plurality of rotatable components of a carding machine, such as the coiler shaft, the calender rollers, the squeezing rollers, the take-off roller, the doffer and the like. The drive includes a speed-variable motor and a gearing which drivingly interconnects the rotatable carding components.

In known carding machines the drive is, in the zone of the web doffing, divided, as a rule, in several branch drives and has a great number of driving elements. The output of the drive motor is, for example, divided into a first group comprising the take-off roller, the doffer and squeezing rollers and into a second group comprising the calender assembly, including the calender rollers and the coiler. While the motor rotates with relatively small rpm, the rpm is increased for the two above-noted groups. For this purpose, several step-up stages in the gearing are necessary; this leads to output losses and thus to a reduction of the efficiency of the drive.

SUMMARY OF THE INVENTION

It is an object of the invention to provide an improved drive of the above-outlined type in which superior efficiency is achieved and in which the number of drive elements is significantly reduced as compared to prior art arrangements.

This object and others to become apparent as the specification progresses, are accomplished by the invention, according to which, briefly stated, the drive comprises a first gear connected to and driven by a motor, a second gear affixed to a shaft and connected slip-free to the first gear to rotate the shaft, a third gear affixed to the shaft, fourth and fifth gears connected to respective first and second rotary components of the carding machine and driven slip-free by the third gear, a sixth gear affixed to the shaft, seventh and eighth gears connected to respective third and fourth rotary components of the carding machine, an additional shaft connected to a fifth rotary component of the carding machine, a ninth gear affixed to the additional shaft; the sixth gear driving slip-free the seventh, eighth and ninth gears, a tenth gear affixed to the additional shaft; and an eleventh gear connected to a sixth rotary component of the carding machine and driven slip-free by the tenth gear.

According to the invention, the drive elements are reduced to the necessary number so that a significant economy is achieved. The mutual correlation of the drive elements with one another provides for a reduced number of power path branches, whereby mechanical losses are reduced. It is a particular advantage of the invention that the output power of the motor follows, in the power path, only a single direction, that is, from high rpm's to low rpm's. This permits to achieve at high rpm's a high power to thus significantly improve the degree of efficiency of the drive.

Preferably, the motor drives the coiler shaft by means of a gearing, such as a bevel gearing or a mechanical gear box. The driving gear is connected with the coiler shaft with the intermediary of the gearing. In such an arrangement of the motor the drive train starts with the highest rpm, namely the rpm of the coiler shaft.

In accordance with another preferred embodiment of the invention, the motor drives directly the driving gear, that is, without the interposition of a gearing. In this manner gear noises are practically eliminated. Expediently, the motor is coupled electrically with a further motor associated with the coiler shaft. The two motors are electrically coupled for synchronous operation, for example, by means of an adapter circuit to ensure that the rpm's of the two motors decrease or increase in an identical ratio. In order to ensure such a synchronous operation, for example, a generator as desired value transmitter may be provided which is associated with the doffer and which applies its signals to a regulator for the drive of the coiler shaft.

The force transmission between the drive elements is effected in a slip-free manner which may be achieved, for example, by meshing gears. Preferably a slip-free transmission element, such as a toothed belt is used. The use of such a transmission element is advantageous since it operates very silently, it needs no maintenance and it is inexpensive to manufacture. When a toothed belt is used, the driving gear and the driven gear constitute sprockets of the drive belt. Expediently, at least one tension roller is provided for the toothed belt in order to set an optimal belt tension for the transmission. Within the drive there are provided exchangeable and permanent toothed gears. Preferably, the permanent toothed gears. The nonexchangeable toothed gears are the transmission and drive elements. The exchangeable toothed gears have the purpose of setting the stretch delay which is dependent on the material have the same number of teeth; this is advantageous from the point of view of manufacture and stocking.

DESCRIPTION OF THE PREFERRED EMBODIMENTS

Figure 1:
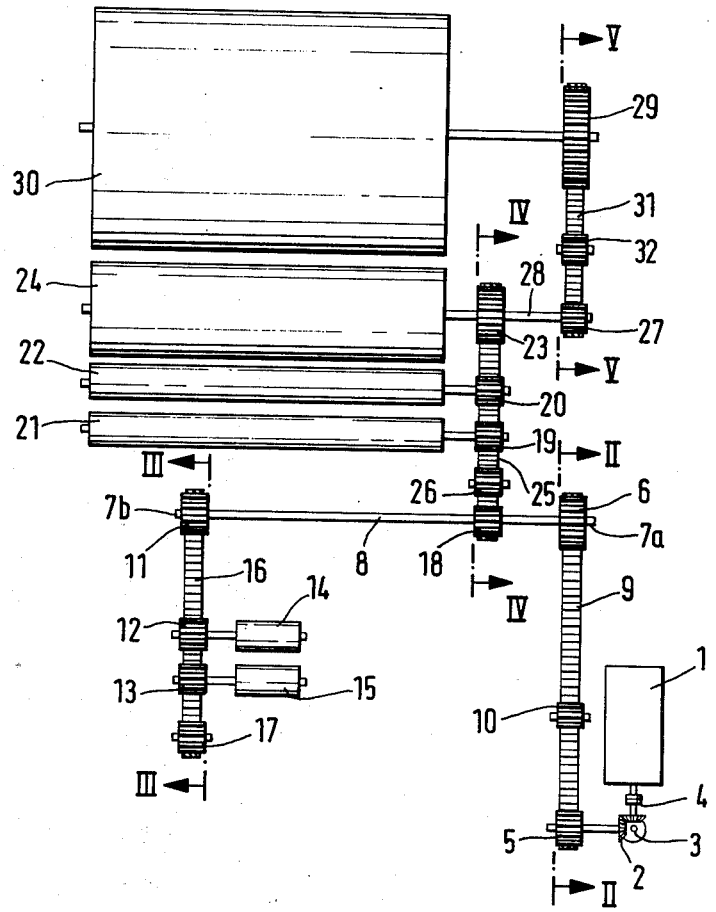
FIG. 1 is a schematic plan view of a preferred embodiment of the invention.
Figure 2:
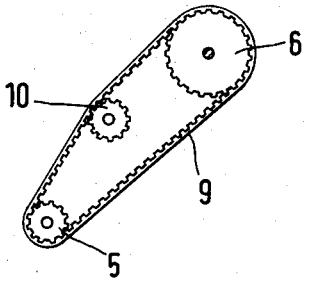
FIG. 2 is a sectional view along line II—II of FIG. 1.
Figure 3:
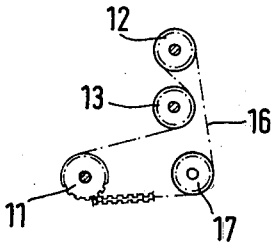
FIG. 3 is a sectional view taken along line III—III of FIG. 1.

Turning now to FIG. 1, a speed-variable motor 1 drives a gearing 2 with the intermediary of a clutch 4. The gearing 2 is drivingly connected to a coiler shaft 3 and also rotates a belt drive gear 5. As also seen in FIG. 2, a toothed belt 9 which has teeth only on its inner face, meshes with the gear 5 and with a further gear 6 mounted on an end *7a* of a shaft 8. The toothed belt 9 is tensioned by means of tension gear 10. Also referring to FIG. 3, to the other end *7b* of the shaft 8 there is mounted a belt drive gear 11 which is rotated by the shaft 8. Two driven gears 12 and 13 serve for driving respective calender rollers 14 and 15. For this purpose, a toothed belt 16 which has teeth on both faces, is trained about the drive gear 11, the driven gears 12 and 13 as well as a tension gear 17.

Figure 4:
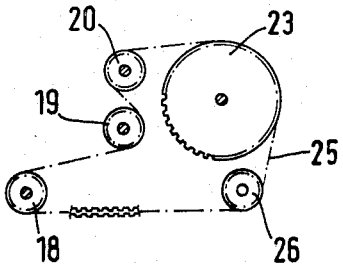
FIG. 4 is a sectional view taken along line IV—IV of FIG. 1.

As seen in FIGS. 1 and 4, on the shaft 8, between the drive gears 6 and 11 there is mounted a further drive gear 18 which, by means of a toothed drive belt 25

Figure 5:
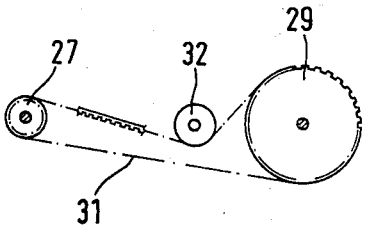
FIG. 5 is sectional view taken along the line V—V of FIG. 1.

(which has teeth on both faces), drives gears 19 and 20 which, in turn, are connected with squeezing rollers 21 and 22. The belt 25 further drives a gear 23 which is mounted on a shaft 28 of a take-off roller 24 for rotating the latter. The toothed belt 25 is tensioned by a tensioning gear 26. As seen in FIGS. 1 and 5, the shaft 28 also carries a drive gear 27 which drives, by means of a toothed drive belt 31 (which has teeth only on its inner face), a gear 29 associated with a doffer 30. The toothed drive belt 31 is tensioned by means of a smooth-faced tensioning roller 32. It is noted that the motor 1 has basically a greater rpm than that of the after-connected carding components. Preferably, the calender rollers 14, 15, the squeezing rollers 21, 22, the take-off roller 24 and the doffer 30 have respectively decreasing rpm's.

Figure 7:
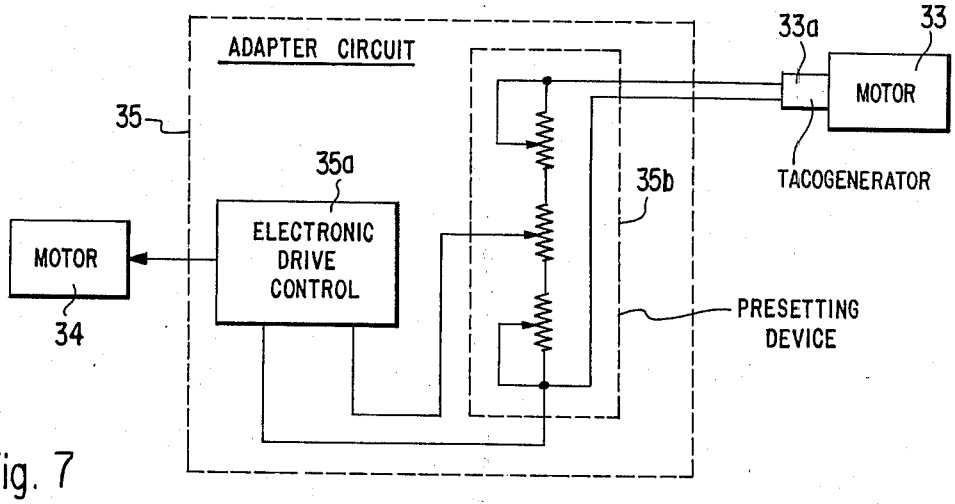
FIG. 7 is a block diagram of a component forming part of the embodiment illustrated in FIG. 6.
Figure 6:
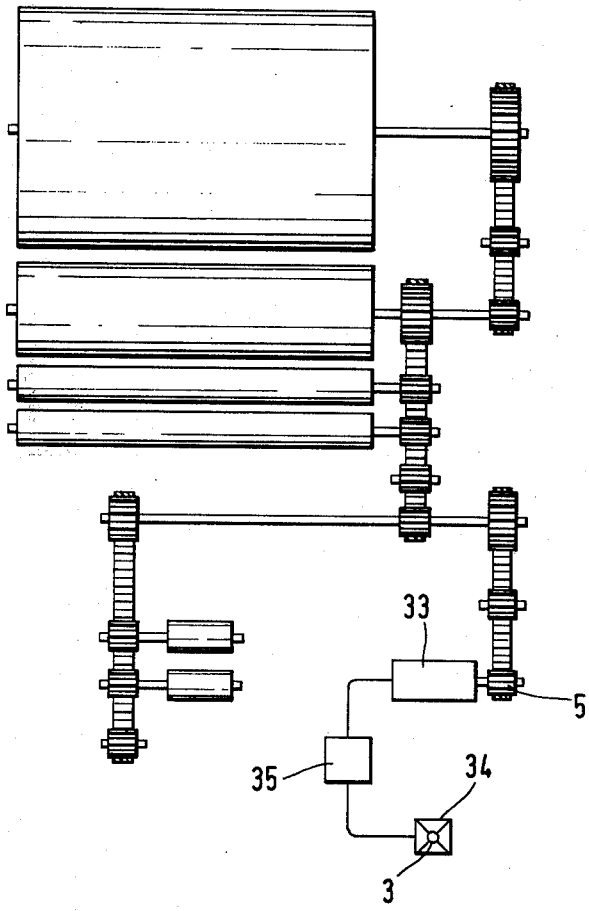
FIG. 6 is a schematic top plan view of another preferred embodiment of the invention.

Turning now to the embodiment illustrated in FIG. 6, this embodiment, as concerns the plurality of rotatable carding components, corresponds to the drive illustrated in FIG. 1. The drive gear 5 in the embodiment according to FIG. 6, however, is directly connected to a speed-variable motor 33. The coiler shaft 3 is driven directly by means of a further speed-variable motor 34. The motor 33 is electrically connected with the motor 34 by means of an adapter circuit 35 to ensure synchronous rotation. The motor 33 is associated with a tacho-generator **33*a*. A block diagram of the adapter circuit 35 is illustrated in FIG. 7. The adapter circuit 35 includes a presetting device 35*b* in which the speed of the coiler shaft is set and which is connected with the tacho-generator 33*a*. The adapter circuit 35 further includes a conventional electronic drive control ("simoreg") 35*a* connected to the presetting device 35*b* and the motor 34**.

It will be understood that the above description of the present invention is susceptible to various modifications, changes and adaptations, and the same are intended to be comprehended within the meaning and range of equivalents of the appended claims.

What is claimed is:

1. In a carding machine, a drive for operating a plurality of rotary components of the carding machine; the drive including a variable-speed motor; the improvement wherein said drive comprises (a) a first gear connected to and driven by said motor;
(b) a first shaft;
(c) a second gear affixed to said first shaft;
(d) first slip-free force transmitting means drivingly connecting said first and second gears to one another, whereby said first gear rotates said first shaft by means of said second gear;
(e) a third gear affixed to said first shaft, whereby said first shaft drives said third gear;
(f) fourth and fifth gears connected to respective calender rollers of the carding machine;
(g) second slip-free force transmitting means drivingly connecting said third, fourth and fifth gears to one another, whereby said third gear rotates said calender rollers by means of the respective said fourth and fifth gears;
(h) a sixth gear affixed to said first shaft;
(i) seventh and eighth gears connected to respective squeezing rollers of the carding machine;
(j) a second shaft connected to a take-off roller of the carding machine;
(k) a ninth gear affixed to said second shaft;
(l) a third slip-free force transmitting means drivingly connecting said sixth, seventh, eighth and ninth gears to one another, whereby said sixth gear rotates said squeezing rollers and said take-off roller by means of the respective said seventh, eighth and ninth gears;
(m) a tenth gear affixed to said second shaft;
(n) an eleventh gear connected to a doffer of the carding machine; and
(o) a fourth slip-free force transmitting means drivingly connecting said tenth and eleventh gears to one another, whereby said tenth gear rotates said doffer by means of said eleventh gear; said calender rollers, said squeezing rollers, said take-off roller and said doffer being comprised in said rotary components.

2. A carding machine as defined in claim 1, wherein a further rotary component is a coiler shaft; the improvement further comprising a gearing connecting said motor with said coiler shaft.

3. A carding machine as defined in claim 2, wherein said first gear is connected to said coiler shaft by means of said gearing.

4. A carding machine as defined in claim 2, wherein said motor directly rotates said first gear.

5. A carding machine as defined in claim 4, wherein said motor is a first motor; further comprising a second motor drivingly connected to said coiler shaft; and electric synchronizing means connecting said first and second motors to one another.

6. A carding machine as defined in claim 1, wherein at least one of said slip-free force transmitting means is a toothed drive belt.

7. A carding machine as defined in claim 6, wherein said first, third, sixth and tenth gear is a driving belt sprocket and said second, fourth, fifth, seventh, eighth, ninth and eleventh gear is a driven belt sprocket.

8. A carding machine as defined in claim 6, further comprising at least one tensioning wheel engaging at least one of said toothed drive belts.

9. A carding machine as defined in claim 1, wherein some of said gears are non-exchangeable toothed gears; said non-exchangeable gears all having the same number of teeth.

10. A carding machine as defined in claim 1, wherein the transmission ratio between said gears is such that the rpm of said motor is greater than that of said rotary components.

11. A carding machine as defined in claim 10, wherein the calender rollers, the squeezing rollers, the take-off roller and the doffer have respectively decreasing rpm's.

* * * * *